US005836746A

United States Patent [19]

Maruyama et al.

[11] Patent Number: 5,836,746

[45] Date of Patent: Nov. 17, 1998

[54] VACUUM PUMP HAVING LUBRICATION AND COOLING SYSTEMS

[75] Inventors: Teruo Maruyama, Hirakata; Yoshikazu Abe, Neyagawa; Akira Takara, Higashiosaka; Yoshihiro Ikemoto, Hirakata, all of Japan

[73] Assignee: Matsushita Electric Industrial Co., Ltd., Osaka-fu, Japan

[21] Appl. No.: 539,219

[22] Filed: Oct. 4, 1995

[30] Foreign Application Priority Data

Oct. 4, 1994 [JP] Japan ..... 6-240066

[51] Int. Cl.[6] ..... F04B 49/06

[52] U.S. Cl. ..... 417/44.1; 417/205; 417/423.4

[58] Field of Search ..... 417/44.1, 199.1, 417/199.2, 201, 205, 423.4, 423.5, 424.1; 418/2, 201.1, 201; 74/DIG. 4, 424.7; 318/654, 625, 101

[56] References Cited

U.S. PATENT DOCUMENTS 4,712,106 12/1987 McNally ..... 340/870.32
4,995,797 2/1991 Tsuboi ..... 418/201.1
5,197,861 3/1993 Maruyama et al. .
5,271,719 12/1993 Abe et al. ..... 417/42
5,295,798 3/1994 Maruyama et al. ..... 418/201.1
5,302,089 4/1994 Maruyama et al. ..... 417/199.1
5,314,312 5/1994 Ikemoto et al. ..... 417/16
5,348,448 9/1994 Ikemoto et al. ..... 417/44.1
5,354,179 10/1994 Maruyama et al. .

*Primary Examiner*—Timothy Thorpe
*Assistant Examiner*—Xuan M. Thai
*Attorney, Agent, or Firm*—Wenderoth, Lind & Ponack

[57] ABSTRACT

A positive displacement vacuum pump, in which a plurality of rotors are driven into synchronous operation by independent motors, uses a rotational position sensor making use of the electromagnetic induction effect for obtaining rotational position information for the individual shafts. The rotational position sensor is cooled.

6 Claims, 7 Drawing Sheets

VACUUM PUMP HAVING LUBRICATION AND COOLING SYSTEMS

BACKGROUND OF THE INVENTION

The present invention relates to a vacuum pump to be used in semiconductor manufacturing equipment or the like.

CVD systems, dry-etching systems, sputtering systems, deposition systems, and the like for semiconductor manufacturing processes essentially involve vacuum pumps to create vacuum environments. Together with the recent years' trend toward enhanced cleanliness, higher vacuum and the like in the semiconductor processes, the demand for vacuum pumps has been growing to increasingly higher levels.

To create a high vacuum, semiconductor equipment normally comprises a vacuum exhaust system formed from a combination of a roughing vacuum pump (positive displacement vacuum pump) and a turbo-molecular pump. After some degree of vacuum pressure is reached from air by the roughing vacuum pump, the pump is switched to the turbo-molecular pump so that a specified high vacuum pressure is obtained.

FIG. 5 illustrates a screw type vacuum pump, which is a kind of conventional positive displacement vacuum pump (roughing vacuum pump) In the conventional screw type vacuum pump, recesses and projections serving as thread grooves 106, 107 are formed on each of rotors 104, 105, so that the recesses and projections are engaged with each other to create a closed space between the two rotors. When the rotors 104, 105 are put into rotation, the volume of the closed space varies whereby the suction and discharge effects are exerted.

FIG. 6 illustrates a thread groove type turbo-molecular pump having turbine blades, which is a kind of conventional kinetic vacuum pump. Referring to FIG. 6, there are shown radial magnetic bearings 155*a*, 155*b* for supporting a rotating shaft 157, and a thrust magnetic bearing 156. A trunk rotor 152 is contained in a housing 151, and the trunk rotor 152 has a turbine blade 153 provided at an upper part thereof and a thread groove 154 at a lower part thereof. The turbo-molecular pump makes the moving blade (turbine blade) and the thread groove rotate at high speed to impart a constant directivity to the molecular movement of the gas, thus accomplishing the pumping action.

However, these vacuum pumps and vacuum exhaust systems incorporating these vacuum pumps in combination have raised the following issues.

(1) Issues involved with the roughing vacuum pump (positive displacement vacuum pump):

In the screw vacuum pump of FIG. 5, synchronized rotation of the two rotors 104, 105 depends on the action of timing gears 110*a*, 110*b*. In more detail, the rotation of a motor 108 is transferred from a drive gear 109*a* to an intermediate gear 109*b*, and further transferred to one timing gear 110*b* out of the timing gears provided on the shafts of the two rotors 104, 105 and engaged with each other. The phase of rotational angles of the two rotors 104, 105 is controlled by the engagement of these two timing gears 110*a*, 110*b*. In this type of vacuum pump, in which gears are used for motor power transmission and synchronized rotation as in this case, lubricating oil 111 filled in the machine actuating chamber containing the above various gears is fed to the gears for lubrication.

The twin-rotor type screw vacuum pump with such a constitution has raised the following issues: (1) A large number of gears are involved for the power transmission and synchronized rotation, resulting in greater number of parts and a complex system construction; (2) The torque transmission using gears and one motor creates an obstacle in attaining higher speeds, resulting in a larger scale system; and the like.

(2) Issues involved with the turbo-molecular pump:

The turbo-molecular pump also incorporates a structure to meet the demand for higher cleanliness in the semiconductor processes, like the roughing vacuum pump mentioned above. For example, in a thread groove type turbo-molecular pump having a turbine blade as shown in FIG. 6, magnetic bearings 155*a*, 155*b*, 156 are used instead of the ball bearing structure with oil lubrication. In the turbo-molecular pump, the space in which bearings are contained is brought into a vacuum state. Whereas lubrication accompanied by mechanical sliding movement is generally difficult to attain in a vacuum in many cases, using magnetic bearings allows this issue to be resolved. However, on the other hand, the individual shafts need to be provided with electromagnets, sensors, and controllers as described above, such that cost increases considerably higher than that of the ball bearing system become an issue.

(3) Issues involved with the vacuum exhaust system (above (1)+(2)):

In conventional roughing vacuum pumps (positive displacement vacuum pumps), air is discharged in a viscous flow region of near atmospheric pressure, where the resulting operating range can reach only to a vacuum pressure of around $10^{-1}$ Pa. Meanwhile, the aforementioned conventional turbo-molecular pump, although able to reach an operating range of around $10^{-8}$ Pa, could not exhaust in the viscous flow region of near atmospheric pressure. Thus, it has been a conventional practice that a roughing vacuum pump (for example, the aforementioned screw pump) is first operated to attain a degree of vacuum to around $10^{0}$–$10^{-1}$ Pa and then switched to a turbo-molecular pump whereby a specified high vacuum is reached.

However, with the recent years' trend to combined semiconductor processes, the so-called multi-chamber system that a plurality of vacuum chambers are evacuated to a vacuum independently of one another has been occupying a mainstream of semiconductor processing facilities. For matching with this trend to the multi-chamber system, it is necessary for every one chamber to be provided with a vacuum exhaust system composed of a roughing vacuum pump and a turbo-molecular pump. If such a vacuum exhaust system is provided for every chamber, the entire vacuum exhaust system equipment would disadvantageously become larger in size and more complex in structure.

Thus, in response to the issues (1) to (3) described above, we inventors have proposed and filed a patent application for a broad-band vacuum pump (U.S. Pat. No. 5,354,179) in which a kinetic vacuum pump is provided on one rotor shaft of a positive displacement vacuum pump composed of two screw rotors, and in which the two shafts are synchronously operated by electronic control, so that one unit serves sufficiently to attain ultra-high vacuum from atmospheric pressure (FIG. 7).

This vacuum pump has two types of pump structures, positive displacement pump section A and kinetic vacuum pump section B. arranged above and below in a housing 200. Gas is sucked in through a suction port 201 provided in the kinetic vacuum pump section B, passed from the kinetic vacuum pump section B to the positive displacement pump section A, and discharged through a discharge port 215.

Rotating shafts 202, 203 have drive motors 204, 205 attached at their lower portions and optical type rotation detecting encoders 206, 207 attached at their lower ends, respectively. These rotation detecting encoders 206, 207 are contained in an encoder housing chamber 208. The rotating shafts 202, 203 are supported by rolling bearings 209 to 212 with grease lubrication above the drive motors 204, 205. The rotating shafts 202, 203 are equipped with thread-grooved rotors 213, 214.

The optical type rotation detecting encoders 206, 207 detect the rotational speeds and rotational positions of the rotating shafts 202, 203, respectively. Based on the resulting information, the numbers of revolutions and rotational angles of the drive motors 204, 205 are controlled so that the two rotating shafts are synchronized. As the optical type encoder, for example, a laser type encoder of high resolution and high responsivity to which diffraction and interference of laser beams are applied is used. FIG. 8 illustrates an example of the laser type encoder. Referring to FIG. 8, a movable slit plate 250 having a multiplicity of slits arranged into a circular shape is driven to rotate by a shaft 251 connected to the rotating shaft. A stationary slit plate 252, opposed to the movable slit plate 250, has slits arranged into a fan shape. Light from a laser diode 253 passes through a collimator lens 254, further through slits of the two slit plates 250, 252, and is received by a light-receiving element 255. When the synchronous operation method by electronic control is applied to drive the vacuum pump by using an optical encoder, there would be issues as described below.

When foreign matter such as contaminants or dust have aggressed into the encoder housing chamber, for example when the contaminants or dust have stuck to the slits of the slit plates, there would occur mis-reads of pulse signals. Also, when grease is used for lubrication of the rolling bearings 209 to 212 (FIG. 7), the grease that has fused under high temperature, if stuck to components of the encoder, may cause similar mis-reads of signals, and is thus a major factor that disturbs the synchronization control.

With the aim of improving the exhaust performance, such as exhaust speed and ultimate vacuum, of the already proposed broad-band vacuum pump, if an oil lubrication method suitable for high speed rotation is adopted for the lubrication of the rolling bearings so that the number of revolutions of the pump is increased, then it would be even more difficult to apply the optical encoder. For this reason, in the oil lubrication method, it is necessary first to provide an oil tank for storing a certain quantity of oil, and further to circulate the oil between the oil tank and the bearings provided at distances from the tank. The portions to be immersed in the oil would extend to quite a broad range, making it very difficult to prevent the encoder from oil contamination in terms of structure.

SUMMARY OF THE INVENTION

The object of the present invention is therefore to provide a vacuum pump which can be further improved to provide for higher speed, smaller size, and enhanced exhaust performance, as well as for substantial improvement in the reliability over the long run.

In accomplishing these and other aspects, according to one aspect of the present invention, there is provided a vacuum pump comprising:

a plurality of rotors contained in a housing;

bearings for supporting rotating shafts of these rotors;

a gas suction hole and a gas discharge hole formed in the housing;

a plurality of motors for rotating the plurality of rotors independently and respectively;

a positive displacement pump section for performing gas suction and exhaust by making use of volumetric change of a space defined by the rotors and the housing; and detection means for detecting angles of rotation and/or numbers of revolutions of the motors, the detection means being rotational position sensors which make use of an electromagnetic induction effect, wherein the plurality of motors are controlled for synchronized rotation by a signal derived from the detection means.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

These and other aspects and features of the present invention will become clear from the following description taken in conjunction with the preferred embodiments thereof with reference to the accompanying drawings.

Figure 1:
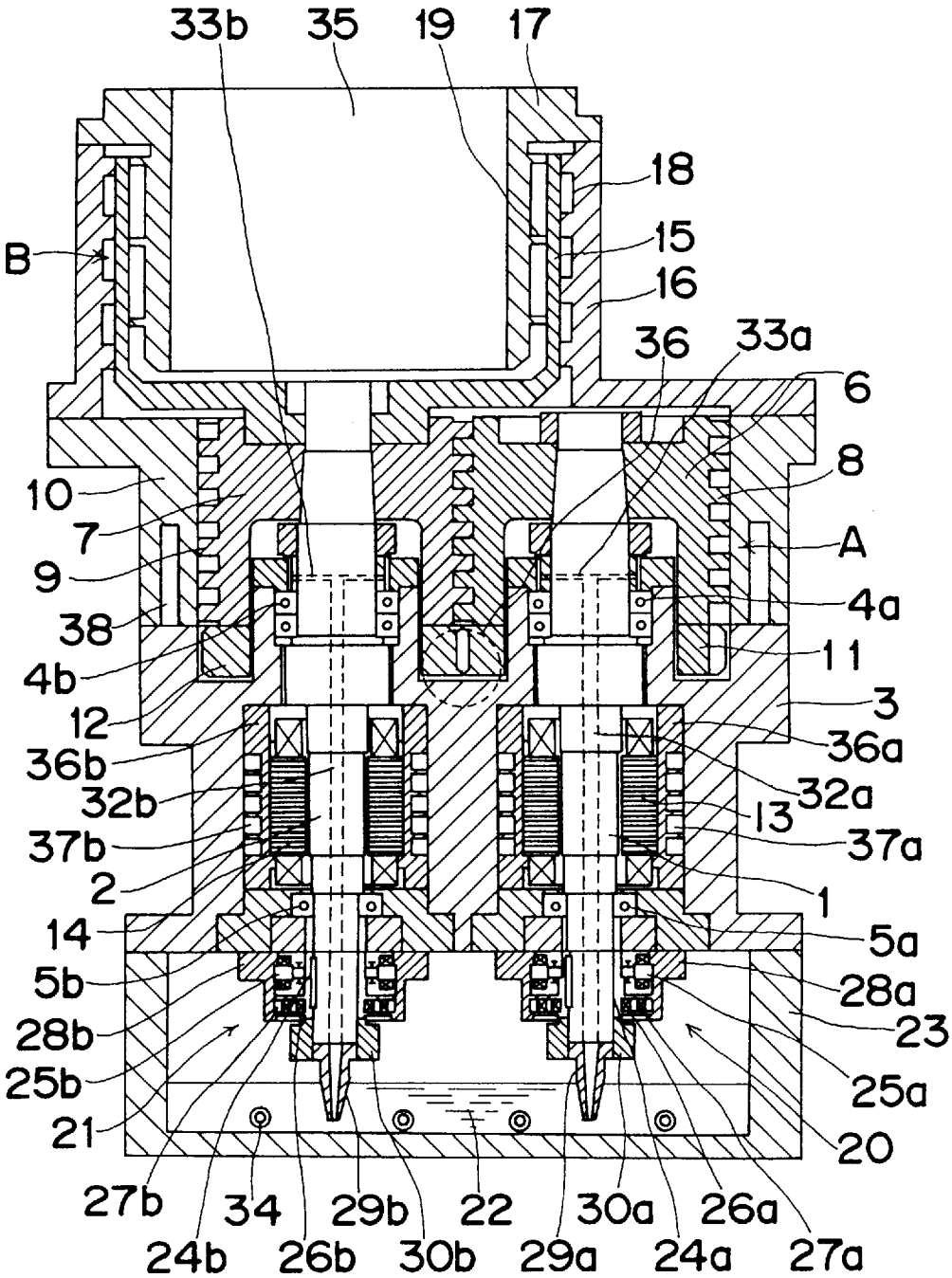
FIG. 1 is a front sectional view showing a vacuum pump of a first embodiment of the present invention.

FIG. 1 shows a vacuum pump as an embodiment of the present invention. A first rotating shaft 1 and a second rotating shaft 2 are supported by bearings 4*a*, 4*b*, 5*a*, 5*b* housed in a housing 3. Trunk rotors 6, 7 are fitted to the first rotating shaft 1 and the second rotating shaft 2, respectively. Thread grooves (a kind of screw groove) 8, 9 are formed on the outer circumferential surfaces of the rotors 6, 7 so as to be engaged with each other. Portions of the rotors 6, 7 at which the two thread grooves 8, 9 are engaged with each other are formed into a positive displacement pump structure section A. More specifically, a closed space formed between the recesses (grooves) and projections of the engaging portions of the two thread grooves 8, 9 and a housing 10 is subject to a volumetric change periodically with the rotation of the two rotating shafts 1, 2. By this volumetric change, the vacuum pump exerts the suction and exhaust effects. Reference numeral 36 denotes a discharge hole of the pump structure section A (indicated by two-dot chain line).

A rotor 15 for a high vacuum pump is provided above the second rotating shaft 2. Designated by numerals 16, 17 are stationary-side housings for housing the rotor 15, and drag grooves 18, 19 for transporting gas molecules are provided on relatively moving surfaces of the rotor 15.

The inner side of the drum-shaped housing 17 serves as a suction hole 35. The portions formed by the drag grooves 18, 19 and the stationary-side housings 16, 17 are formed into a high vacuum pump structure section B. Rotational position sensors 20, 21 serving as detection means for detecting angles of rotation and/or numbers of revolutions of the motors are provided at lower end portions of the first rotating shaft 1 and the second rotating shaft 2. These rotational position sensors 20, 21 are contained in a sensor housing chamber 23 serving also as an oil tank for storing oil.

Figure 2:
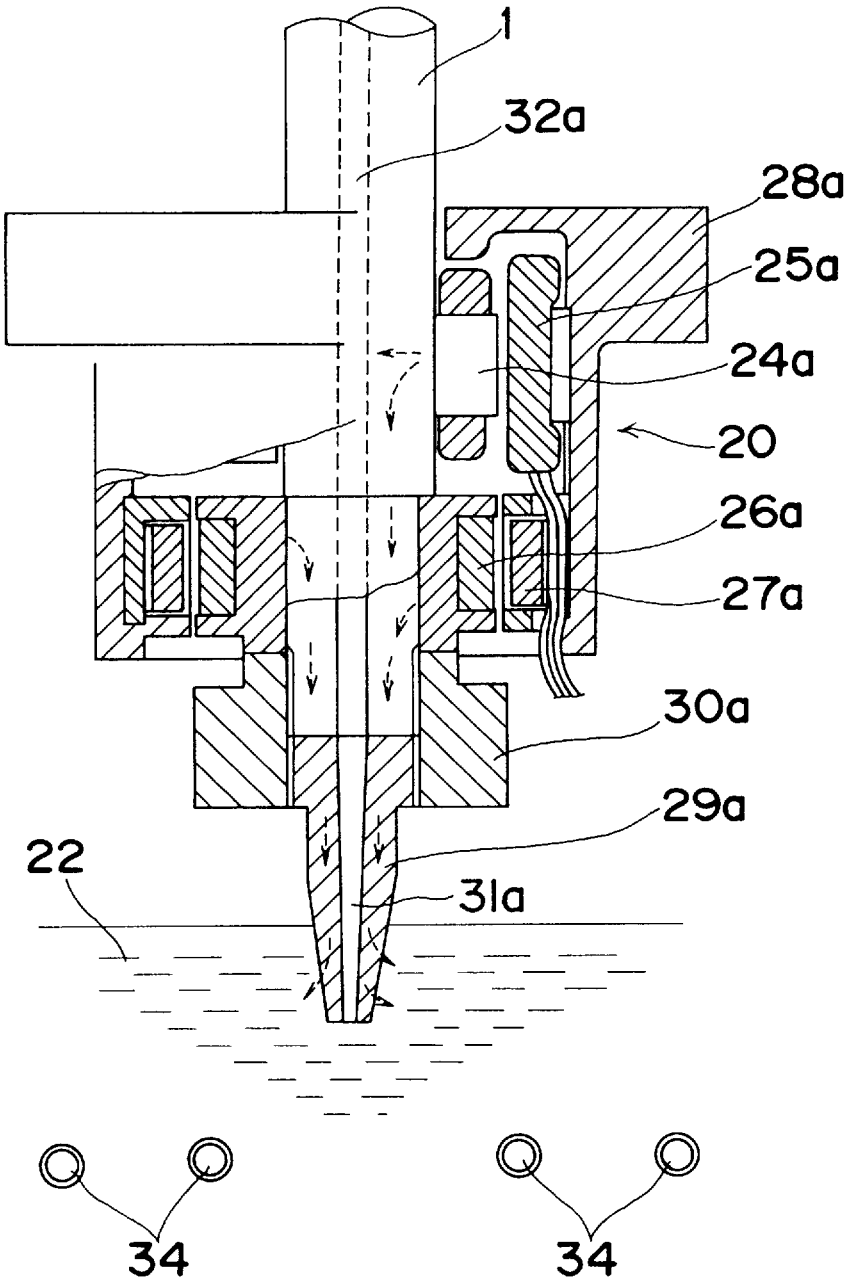
FIG. 2 is an enlarged view of a resolver portion of FIG. 1.

The rotational position sensors 20, 21 provided at the lower end portions of the two rotating shafts 1, 2 are implemented by brushless resolvers making use of the electromagnetic induction effect in this embodiment. The resolver is an analog sensor having infinite resolution like a synchro and therefore capable of obtaining sufficiently high signal levels with stability. FIG. 2 is an enlarged view of the rotational position sensor (resolver). Reference numerals 24*a*, 24*b* denote rotors of the resolvers, while 25*a*, 25*b* denote their stators; 26*a*, 26*b* denote rotors of the rotary transformers, while 27*a*, 27*b* denote their stators.

As shown in FIGS. 1 and 2, at lower end portions of the two rotating shafts 1, 2, the bearings 5*a*, 5*b* are provided above the rotational position sensors 20, 21 so as to serve also for support of the rotating shafts 1, 2 in order that the sensor rotors 24*a*, 24*b* can be prevented from axial fluctuations and thereby stable outputs of the sensors 20, 21 can be obtained. Reference numerals 28*a*, 28*b* denote housing cases for the stators 25*a*, 25*b*; 29*a*, 29*b* denote oil pump nozzles (or suctions members) provided at end portions of the two rotating shafts 1, 2, so as to be immersed in oil; and 30*a*, 30*b* denote bushings for fixing the nozzles 29*a*, 29*b* and the two rotating shafts 1, 2. Numerals 31*a*, 31*b* denote inversely tapered circulation passages formed at center portions of the nozzles 29*a*, 29*b* and having functions as centrifugal pumps, and 32*a*, 32*b* denote axial-flow passages formed so as to extend through the insides of the rotating shafts 1, 2.

Oil 22 drawn up through the nozzles 29*a*, 29*b* is elevated through the axial-flow passages 32*a*, 32*b* of the two rotating shafts 1, 2, and supplied through openings 33*a*, 33*b* to the bearings 4*a*, 4*b*.

The oil 22 within the oil tank 23 is cooled by a cooling pipe 34. Cooling water is circulated in the cooling pipe 34. Meanwhile, the rotating shafts 1, 2 are normally kept in a high temperature state by compression heat of the positive displacement pump as well as the motor serving as heat-generating sources. Upper portions (pump side) of the rotating shafts 1, 2 under high-speed rotation are in a vacuum so that heat radiation from outside is not expected. Thus, generally, it is often difficult to cool the rotating shafts. In such a case, there is a fear of performance deterioration due to temperature rise in the rotors 24*a*, 24*b*, 26*a*, 26*b* of the resolvers.

Elevation in temperature of the resolvers would raise several issues including:

(1) Characteristic deterioration due to increase in the winding resistance;

(2) Characteristic change due to a change in the gap between a rotor and a stator, which is caused by thermal expansion of the rotors; and (3) Deterioration in the insulating performance due to burn-out of protective coatings of the windings.

In the present embodiment, the nozzles 29*a*, 29*b* for oil suction are provided just below the rotors 26*a*, 26*b* of the resolvers. By immersing the nozzles 29*a*, 29*b* in the cooled oil 22 and by drawing up the oil, the lower end portions of the rotating shafts 1, 2 are cooled so that the rotors 26*a*, 26*b* of the resolvers are kept at low temperatures (the flow of heat radiation is shown by the chain-line arrows in FIG. 2).

The stators of AC servo motors 13, 14, which are heat-generating sources on the stationary side of the vacuum pump, are cooled by cooling passages 37*a*, 37*b* formed in sleeves 36*a*, 36*b* which contain the motors 13, 14. The heat generation by the compression effect of the positive displacement pump is cooled by a cooling passage 38 formed in the housing 10.

Gears 11, 12 for preventing the thread grooves 8, 9 from contacting each other are provided on lower-end outer circumferential surfaces of the rotors 6, 7.

Figure 3:
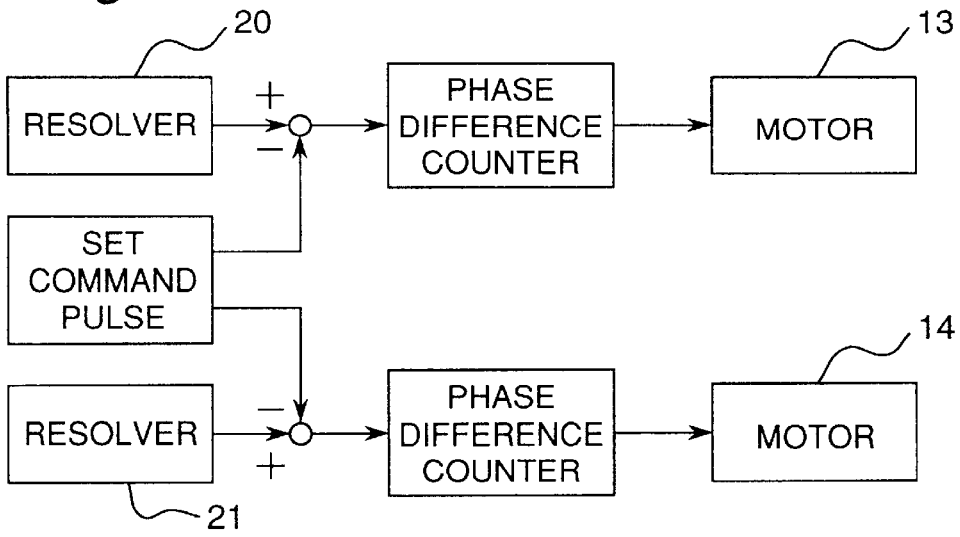
FIG. 3 is a block diagram showing a synchronization control method for the pump.

The rotors 6, 7 are rotated at high speed of several tens of thousands of rpm by the AC servo motors 13, 14 provided independently at lower portions of the rotating shafts 1, 2, respectively, while the rotors 6, 7 keep a constant number-of-revolutions ratio determined by their outer diameter ratio. The PLL synchronization control for the two rotating shafts 1, 2 in this embodiment is implemented by a method as shown in the block diagram of FIG. 3. In more detail, whereas magnetic type resolvers 20, 21 are provided at lower end portions of the rotating shafts 1, 2 as shown in FIG. 1, output pulses from these resolvers 20, 21 are checked for a set command pulse (target value) set by assuming virtual rotors. The deviations between the target value and output values (numbers of revolutions and angles of rotation) from the shafts 1, 2 are calculated by a phase-difference counter, whereby the rotation of the servo motors 13, 14 of the individual shafts 1, 2 is controlled so as to cancel the deviations.

Although the magnetic type resolvers are used as the detection means for detecting the angles and/or numbers of revolutions of the motors in the embodiment, the detection means may be means for detecting angles of rotation and/or numbers of revolutions of the motors by making use of electromotive force generated by electromagnetic induction effect of the motors themselves which is generated by the rotations of the motors.

Figure 4:
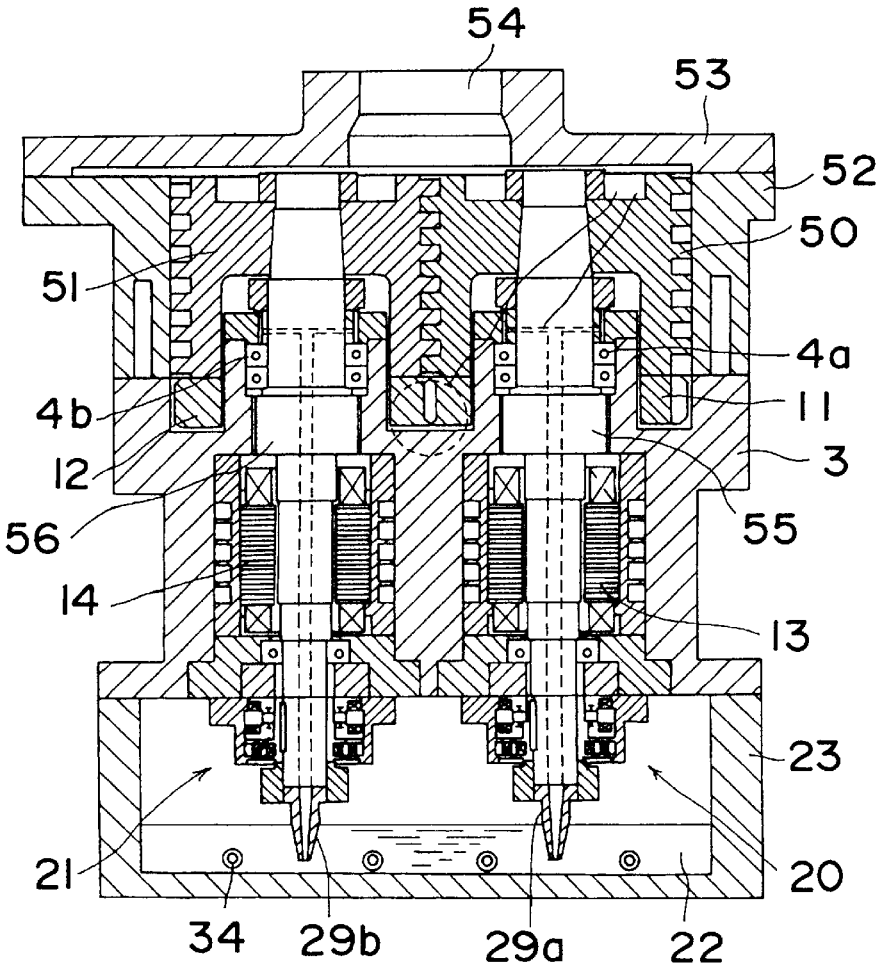
FIG. 4 is a front sectional view showing a vacuum pump of a second embodiment of the present invention.
Figure 5:
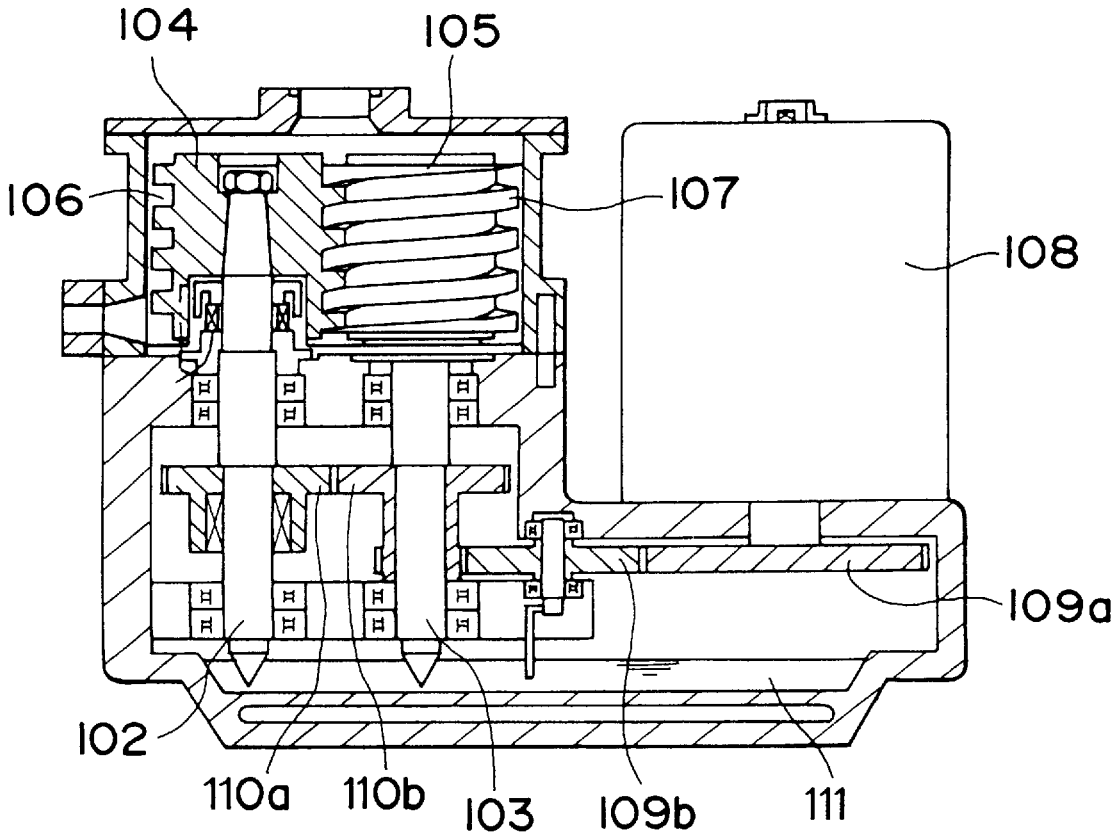
Fig. 5 PRIOR ART
FIG. 5 is a sectional view of a conventional screw type pump.
Figure 6:
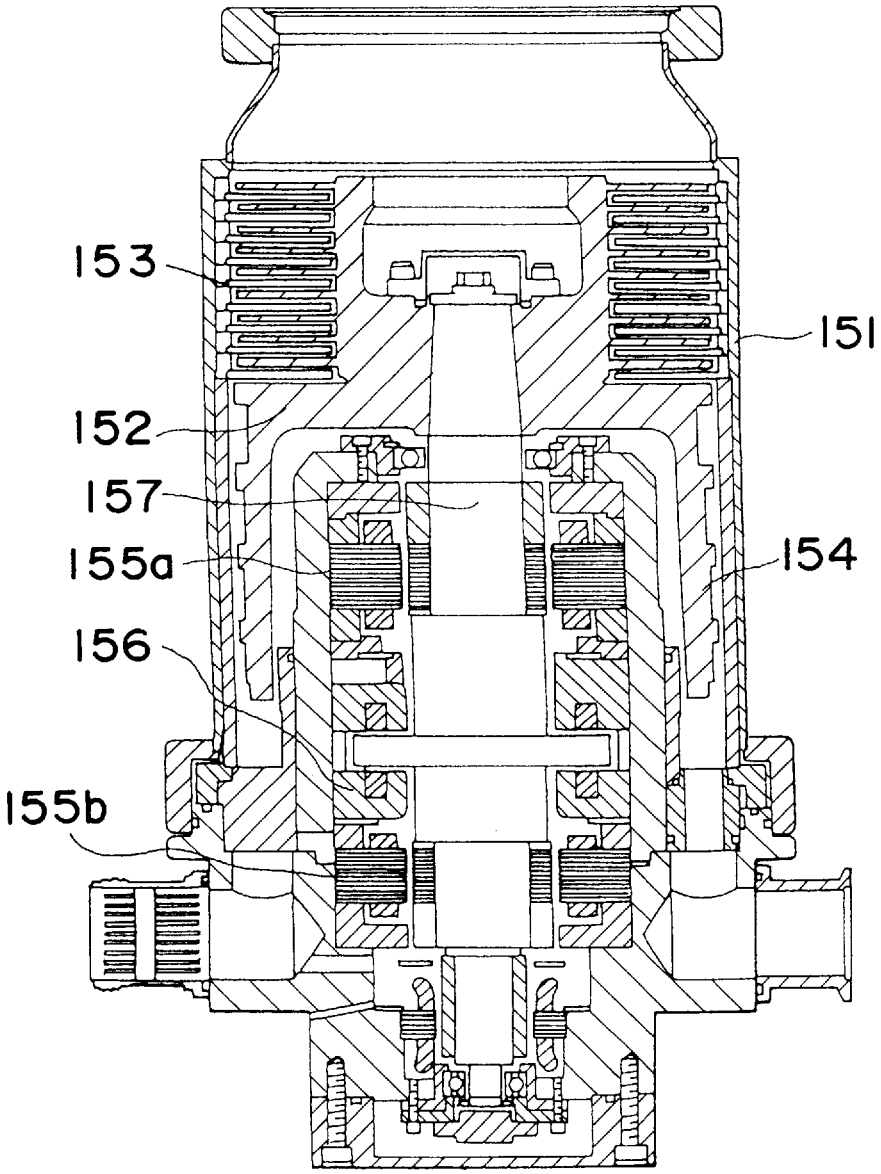
Fig. 6 PRIOR ART
FIG. 6 is a sectional view of a conventional turbo-molecular pump.
Figure 7:
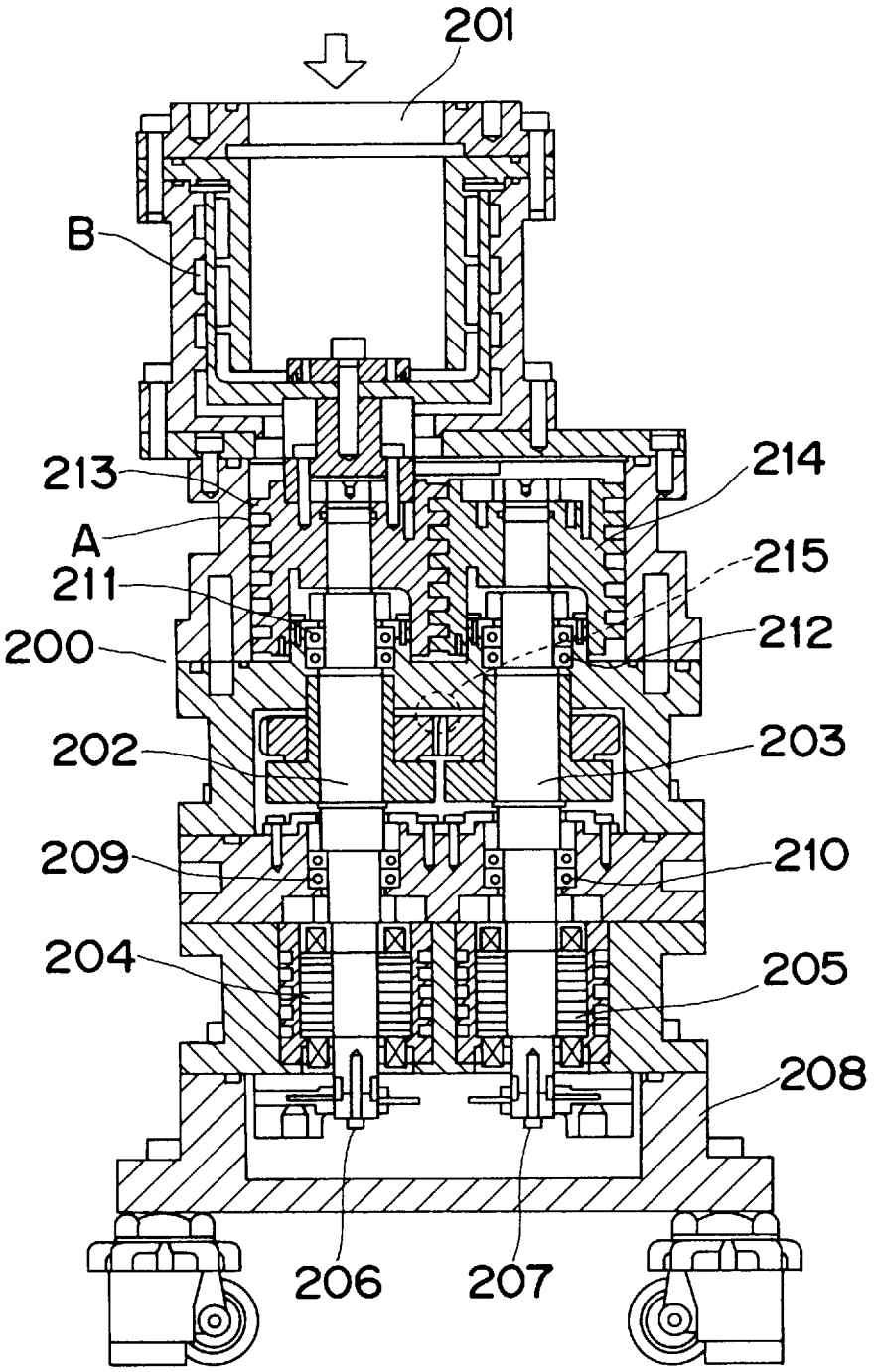
Fig. 7 PRIOR ART
FIG. 7 is a front sectional view of the already proposed broad-band vacuum pump.
Figure 8:
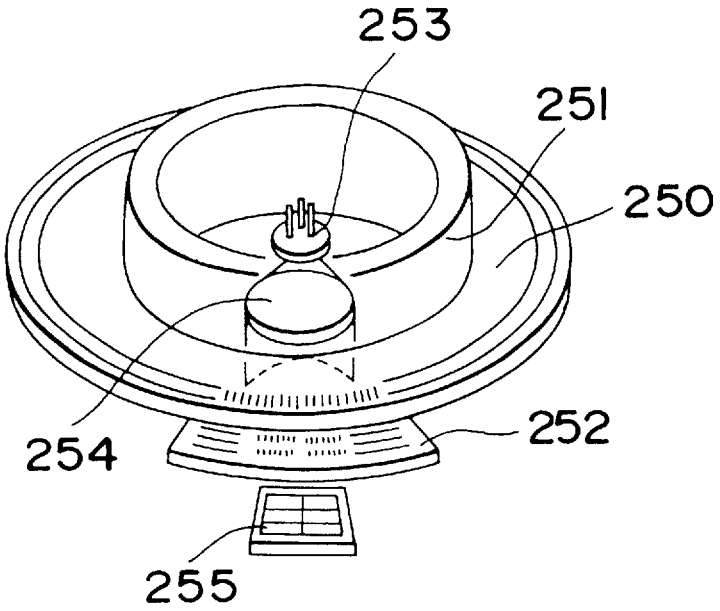
Fig. 8 PRIOR ART
FIG. 8 is a perspective view of an optical encoder.

Whereas an embodiment in which the present invention is applied to a broad-band pump incorporating a roughing vacuum pump and a high-vacuum pump in combination has been described hereinabove, the present invention may of course be applied also to the roughing vacuum pump. Referring to FIG. 4, there are shown screw rotors of the roughing vacuum pump 50, 51, a housing 52, a top housing 53, a suction hole 54, and rotating shafts 55, 56.

The fluid rotating system according to the present invention may be a compressor for air conditioning or the like. The positive displacement pump structure section A and the kinetic vacuum pump section B formed in the rotors of the rotating section of the system may be of the roots type, gear type, single-lobe type, double-lobe type, screw type, outer-peripheral piston type (which are shown in U.S. Pat. No. 5,354,179), and the like.

If the positive displacement vacuum pump structure section of the present invention is so arranged that the rotors have thread grooves (including screw grooves) provided at their outer peripheries, then the thread groove type rotors, unlike deformed rotors such as the gear type rotor and the roots type rotor, can be such that their cross section perpendicular to the rotation center axis is relatively near circular shape, in which case a cavity can be formed up to the proximity of the outer periphery. Thus, the internal space of the rotors can be a large area, lending itself to use for bearings and the like, as shown in the embodiment. As a result, it becomes feasible to downsize the system to a great extent.

The vacuum pump of the present invention utilizes the electromagnetic induction effect for the detection of the angles of rotation and numbers of revolutions as well as the already proposed synchronous operation method by electronic control. Therefore, the vacuum pump can be improved in reliability to a great extent and also can prevent mis-reads of signals from being caused by oil or grease contamination.

In the embodiments of the present invention, the resolvers (or synchros) making use of electromagnetic induction effect for the detection of the rotational angles and numbers of revolutions of the two shafts are employed. The resolver is a kind of rotary transformer in which, when an AC voltage is applied to the primary side, an output voltage is induced to the secondary side by the principle of transformer, where the coupling coefficient induced by the rotational angle varies at the same time. Therefore, even if contaminant or dust have aggressed into the housing chamber for the resolver, the rotational position signal is less affected.

Further, let us assume that, for applying oil lubrication to the bearings, the oil tank is provided at the end of the rotating shaft, with the formation of a closed loop in which the oil is drawn up from the tank, fed to the bearings, and fed back the oil to tank. Then, even if the resolver is provided on the passage within the closed loop, the induced voltage to be developed inside the resolver as a transformer is less affected by the oil, so that the synchronization control can be operated properly.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom

What is claimed is:

1. A vacuum pump comprising:

a housing having a gas suction hole and a gas discharge hole;

a plurality of rotors contained in said housing;

bearings for supporting rotating shafts of said rotors;

a plurality of motors for rotating the plurality of rotors independently and respectively;

a positive displacement pump section for performing gas suction and exhaust by making use of volumetric change of a space defined by the rotors and the housing; and a detector for detecting angles of rotation and/or numbers of revolutions of the motors, the detector comprising rotational position sensors which make use of electromagnetic induction effect and which respectively include rotors, wherein the plurality of motors are controlled for synchronized rotation by a signal derived from the detector;

an oil tank provided at first end portions of the rotating shafts; and an oil pump which functions to cause oil within the oil tank to be drawn up and fed to the bearings by making use of rotation of the rotating shafts, and wherein each of the rotating shafts has an oil flow passage provided for introducing the oil to the bearings;

a cooling system for cooling the oil within the oil tank, wherein a suction member of the oil pump is immersed in the cooled oil of the oil tank; and wherein at least one of the rotors of the rotational position sensors is formed outside the suction member.

2. The vacuum pump according to claim 1, wherein said rotational position sensors comprise analog sensors provided respectively between the rotating shafts and the housing.

3. The vacuum pump according to claim 2, wherein each of the analog sensors comprises a synchro or a resolver.

4. A vacuum pump comprising:

a housing having a gas suction hole and a gas discharge hole;

a plurality of rotors contained in said housing;

bearings for supporting rotating shafts of said rotors;

a plurality of motors for rotating the plurality of rotors independently and respectively;

a positive displacement pump section for performing gas suction and exhaust by making use of volumetric change of a space defined by the rotors and the housing; and a detector for detecting angles of rotation and/or numbers of revolutions of the motors, the detector comprising rotational position sensors which make use of electromagnetic induction effect and which respectively include rotors, wherein the plurality of motors are controlled for synchronized rotation by a signal derived from the detector;

an oil tank provided at first end portions of the rotating shafts; and an oil pump which functions to cause oil within the oil tank to be drawn up and fed to the bearings by making use of rotation of the rotating shafts, and wherein each of the rotating shafts has an oil flow passage provided for introducing the oil to the bearings;

a cooling system for cooling the oil within the oil tank, wherein a suction member of the oil pump is immersed in the cooled oil of the oil tank; and wherein at least one of the rotors of the rotational position sensors is formed outside the rotating shaft connected to the suction member and in proximity to the suction member.

5. The vacuum pump according to claim 4, wherein said rotational position sensors comprise analog sensors provided respectively between the rotating shafts and the housing.

6. The vacuum pump according to claim 5, wherein each of the analog sensors comprises a synchro or a resolver.

* * * * *